US010041023B2

(12) United States Patent
Jones et al.

(10) Patent No.: US 10,041,023 B2
(45) Date of Patent: Aug. 7, 2018

(54) COMPOSITION

(71) Applicants: Reckitt Benckiser (Brands) Limited, Slough, Berkshire (GB); Huntsman International LLC, Salt Lake City, UT (US)

(72) Inventors: Chris Jones, Venice (IT); Laura Roscioli, Venice (IT); Fabio Constiniti, Venice (IT); Anna Marchiani, Venice (IT); Elisa Nardo, Venice (IT); Simone Scoizzato, Venice (IT); Elisa Scomparin, Venice (IT); Dora Zamuner, Venice (IT); Alessandra Andreoli, Salt Lake City, UT (US); Laura Radice, Salt Lake City, UT (US)

(73) Assignees: Reckitt Benckiser (Brands) Limited, Slough, Berkshire (GB); Huntsman International LLC, Salt Lake City, UT (US)

( * ) Notice: Subject to any disclaimer, the term of this patent is extended or adjusted under 35 U.S.C. 154(b) by 0 days.

(21) Appl. No.: 15/121,820

(22) PCT Filed: Feb. 23, 2015

(86) PCT No.: PCT/GB2015/050505
§ 371 (c)(1),
(2) Date: Aug. 26, 2016

(87) PCT Pub. No.: WO2015/128619
PCT Pub. Date: Sep. 3, 2015

(65) Prior Publication Data

US 2017/0073618 A1 Mar. 16, 2017

(30) Foreign Application Priority Data

Feb. 28, 2014 (GB) ..... 1403550.5

(51) Int. Cl.

| | |
|---|---|
| ***C11D 3/39*** | (2006.01) |
| ***C11D 3/395*** | (2006.01) |
| ***B08B 3/04*** | (2006.01) |
| ***C11D 3/37*** | (2006.01) |
| ***C11D 11/00*** | (2006.01) |

(52) U.S. Cl.
CPC ..... *C11D 3/3726* (2013.01); *C11D 3/39* (2013.01); *C11D 3/3942* (2013.01); *C11D 11/0017* (2013.01)

(58) Field of Classification Search
CPC ..... C11D 3/3726; C11D 3/39; C11D 3/3942; C11D 3/395; C11D 11/0017; B08B 3/04
See application file for complete search history.

(56) References Cited

U.S. PATENT DOCUMENTS

| | | | |
|---|---|---|---|
| 4,068,035 | A | 1/1978 | Voilland et al. |
| 2004/0224871 | A1 | 11/2004 | Penninger et al. |

FOREIGN PATENT DOCUMENTS

| | | | | |
|---|---|---|---|---|
| DE | 19853845 | A1 | 5/2000 | |
| EP | 1903097 | A1 | 3/2008 | |
| GB | 1578930 | | 11/1980 | |
| GB | 2312219 | * | 10/1997 | ..... D06L 3/02 |
| GB | 2312219 | A | 10/1997 | |
| WO | 9960087 | A1 | 11/1999 | |

OTHER PUBLICATIONS

GB Search Report for corresponding application GB 1403550.5 dated Aug. 26, 2014.
International Search Report and Written Opinion of the International Searching Authority for corresponding application PCT/GB2015/050505 dated May 4, 2015.

* cited by examiner

*Primary Examiner* — Brian P Mruk
(74) *Attorney, Agent, or Firm* — Norris McLaughlin & Marcus PA

(57) ABSTRACT

A composition comprises a source of oxygen and a polyurethane for use in a treatment operation in cleaning a fabric material.

19 Claims, No Drawings

COMPOSITION

This is an application filed under 35 USC 371 based on PCT/GB2015/050505, and claims priority to that application as well as GB 1403550.5 filed 28.February.2014. The present application claims the full priority benefit of these prior applications and herein incorporates by reference the full disclosures of these prior applications.

This invention relates to a composition for cleaning textiles, including carpets, clothing and fabrics and to a method of using said composition.

Compositions exist for cleaning stains, spills and the like from carpets, clothing and other fabrics and textile materials. However, problems arise in the relation to the use of these compositions in that simply spraying the material onto a fabric or carpet and then rubbing the composition into the stain with a cloth does not give consistent results and does not make for best use of the compositions provided. Certain agents have been found to provide effective stain removal but are disadvantageous in that the agents themselves leave a reside.

According to a first aspect of the invention there is provided a composition comprising a source of oxygen and a polyurethane for use in a treatment operation in cleaning a fabric material.

According to a second aspect of the invention there is provided a method comprising the application of a composition comprising a source of oxygen and a polyurethane to a fabric material in a treatment operation in cleaning a fabric material.

Preferably the treatment operation comprises a cleaning operation. Most preferably the cleaning operation comprises a pre-treatment operation. Herein it is to be understood that the pre-treatment comprises a step in a washing process; wherein as a preferred example the composition is applied to a fabric material, followed by a more through washing of the fabric material, e.g. in or with the use of an automatic washing machine.

Preferably the fabric material comprises a clothing material. Consequently preferably the washing operation comprises washing in an automatic laundry washing machine.

The polyurethane (provided as a softening agent), was found to deliver unexpected cleaning/stain removal additional benefits when formulated into fabric treatment compositions. The effect was achieved without any residue being left on the fabric being cleaned.

Preferably the source of oxygen is present in an amount of up to 13 wt %, more preferably 1 to 12 wt %, more preferably 2 to 11 wt %, more preferably 3 to 10 wt % and most preferably 4% to 9 wt %.

Examples of source of oxygen that may be used are oxygen bleaches/peroxygen bleaching actives.

Peroxygen bleaching actives are: perborates, peroxides (e.g. hydrogen peroxide), peroxyhydrates, persulfates, percarbonate; and especially the coated grades that have better stability. The persalts can be coated with silicates, borates, waxes, sodium sulfate, sodium carbonate and surfactants solid at room temperature. For liquid compositions the bleach is preferably peroxide bleach, most preferably hydrogen peroxide. A preferred source of oxygen is hydrogen peroxide. Sources of oxygen other than $H_2O_2$ can be used. Preferably the composition is liquid in format. This shall be taken to comprise all fluids/liquids such as gels and suspensions.

Preferably the polyurethane is present in an amount of 0.01 to 10 wt %, more preferably 0.05 to 5 wt %, more preferably 0.08 to 3 wt %, more preferably 0.08 to 2 wt % and most preferably 0.1% to 0.8 wt %.

Generally the polyurethane is a reaction product of a polyhydroxyl compound with a diisocyante. Preferably, the diisocyanate has the formula Q(NCO)2, wherein Q is selected from the group consisting of an aliphatic hydrocarbon chain with 4 to 12 carbon atoms, a cycloaliphatic hydrocarbon chain with 6 to 25 carbon atoms, an aromatic hydrocarbon chain with 6 to 15 carbon atoms, or an aryliphatic hydrocarbon chain with 7 to 15 carbon atoms. The most preferred diisocyanate is hexamethylene diisocyanate.

The polyhydroxyl compound is preferably selected from the group consisting of ethylene oxide polyethers and ethylene oxide/propylene oxide mixed polyethers (with a block or random distribution) having 2 or 3 hydroxyl groups with a predominant proportion by weight of ethylene oxide units. The polyether groups may also contain secondary or tertiary amine groups. These compounds provide polyurethane with polyoxyalkylene groups.

The polyurethane preferably comprises polyoxyalkylene groups and ionic groups. The ionic groups include alkali and ammonium carboxylate and sulfonate groups, together with ammonium groups. Preferably, the polyurethane product comprises terminal polyalkylene oxide chains with an ethylene oxide unit content of 0.5 to 10 wt. %, relative to the polyurethane. Preferably, the polyurethane comprises 0.1 to 15 milliequivalents of ammonium, sulfonium, carboxylate, and/or sulfonate groups per 100 g of polyurethane.

Free isocyanate groups that are left unreacted after the reaction of the polyhydroxyl compound with the diisocyanate can be blocked with usual blocking agents like sodium hydrogensulfite or ketone oximes and the like.

The most preferred polyurethane is a polyether-based sulfite-blocked oligourethane in particular a sodium hydrogensulphite adduct of a ethylene oxide/propylene oxide copolymer reacted with a diisocyanate such as hexamethylene diisocyanate.

Surfactant

The preferred compositions contain from about 0.05% to about 15 wt % of a nonionic surfactant. Suitable examples of which include $C_8$-$C_{18}$ alcohols alkoxylated with 3 to 6 moles of ethylene oxide. A wide variety of alkoxylated fatty alcohols are known to the art and these vary considerably in HLB (hydrophile-lipophile balance). For purposes of this invention, it is preferable to employ an alkoxylated alcohol which is relatively hydrophobic. Preferred surfactants are fatty alcohols having from about 8 about 15 carbon atoms, alkoxylated with about 4 to 6 moles of ethylene oxide. A particularly preferred surfactant is that sold under the trademark Empilan KCL5 and has a formulation of $C_{12}$-$C_{15}$ alcohols alkoxylated with 5 moles of ethylene oxide. These nonionic surfactants are preferably present in the compositions of this invention in amounts ranging from 0.1% to 2 wt %, more preferably from 0.3% to 1 wt %.

Other

To bring the pH to within the desired range of a sufficient amount of an acid or an alkali is added to adjust the pH.

The compositions of this invention desirably also contain at least one organic solvent which is preferably water-miscible. Such useful organic solvents include: the linear alcohols such as ethanol, isopropanol and the isomers of butanol; diols; glycols such as ethylene glycol, propylene glycol and hexylene glycol; glycol ethers, etc. Low molecular weight solvents, i.e. those from 1 to 8 carbon atoms, are preferred. A particularly preferred solvent is propylene glycol.

The composition additionally comprises up to 10% wt, 8% wt, 6% wt, 4% wt, 2% wt, 1% wt or 0.5% wt of minor ingredients selected from one or more of the following: dye, fragrance, preservative, optical brightener, antibacterial agent, dye transfer inhibitor or a bittering agent.

In order to provide desirable rheologic characteristics to the composition of this invention, thickeners should be added. These include polymeric substances which function as viscosity stabilizers and aid in enzyme stabilization. Exemplary of such polymeric compositions are polyacrylic acid, polymethacrylic acid, acrylic/methacrylic acid copolymers, hydrolyzed polyacrylamide, hydrolyzed polymethacrylamide, hydrolyzed polyacrylonitrile, hydrolyzed polymethacrylonitrile, etc. Water soluble salts or partial salts of these polymers, as well as their respective alkali metal or ammonium salts can also be used. A preferred polymeric substance is sold under the trademark Polygel DA, which is a polyacrylic acid having a molecular weight greater than 1,000,000. These polymers are used in amounts ranging from about 0.1% to 1 wt %, preferably about 0.4 wt %.

A preferred thickening agent is xanthan gum which may be present in an amount of from between 0.1% and 0.5 wt %, preferably about 0.3 wt %. In addition to providing beneficial viscosity characteristics to the compositions, xanthan gum also assists in the removal of certain stains.

Cellulose derivatives such as hydroxyethyl cellulose, may be used as thickeners as can (co)polymeric thickeners, e.g. those based on acrylates, such as Polygel W301 from 3V Sigma.

Additionally the desired viscosity may be achieved through the use of surfactants/combination of surfactants, e.g. with the surfactants of the invention.

Optionally, the compositions may additionally comprise from 0.01 to 30% wt, preferably from 2 to 20% wt of bleach precursors. Suitable bleach precursors are peracid precursors, i.e. compounds that upon reaction with hydrogen peroxide product peroxyacids. Examples of peracid precursors suitable for use can be found among the classes of anhydrides, amides, imides and esters such as acetyl triethyl citrate (ATC), tetra acetyl ethylene diamine (TAED), succinic or maleic anhydrides.

Suitable preservatives include the isothiazolinones sold under the trademark Kathon DP3 and available from Rohm & Haas.

The compositions may also comprise suspended particles which differ in colour or shade from the aqueous liquid composition. These particles (speckles) can serve an aesthetic purpose. Speckles can be present in amounts ranging from about 0.01 to about 1.0 weight percent. Typically, they will consist of a solid material which can function as an additional stabilizing agent, a coating which melts at a suitable temperature, and a small amount of dye.

The amount of water present in the composition is at least 50% wt, 60% wt, 70% wt or 80% wt.

The invention shall be described with reference to the following non-limiting Examples.

EXAMPLES

Example 1

A formulation in accordance with the invention was prepared as below. (product A)

| Description | % as active |
|---|---|
| Water | to 100 |
| NaOH 50% | 1.000 |
| Sulphonic Acid | 6.400 |
| Surfactant - Non Ionic | 12.750 |
| HEDP-Phosphonate | 0.120 |
| H2O2 50% | 8.000 |
| Antioxidant | 0.025 |
| Perfume | 0.500 |
| optical brightener | 0.100 |
| anionic polyurethane | 0.525 |
| Dye | 0.00037 |
| perlizer | 0.300 |
| Opacifier | 0.030 |

A comparative formulation was prepared as below. (Product B)

| Description | % as active |
|---|---|
| Water | to 100 |
| NaOH 50% | 1.000 |
| Sulphonic Acid | 6.600 |
| Surfactant - Non Ionic | 14.000 |
| HEDP-Phosphonate | 0.120 |
| H2O2 50% | 8.000 |
| Antioxidant | 0.025 |
| Perfume | 0.500 |
| optical brightener | 0.100 |
| Poliquat | 0.135 |
| Silicon | 0.050 |
| Dye | 0.00037 |
| Perlizer | 0.300 |
| Opacifier | 0.030 |

A reference formulation was prepared as below. (Product C)

| Description | % as active |
|---|---|
| Water | to 100 |
| NaOH 50% | 1.000 |
| Sulphonic Acid | 6.600 |
| Surfactant - Non Ionic | 14.150 |
| HEDP-Phosphonate | 0.120 |
| H2O2 50% | 8.000 |
| Antioxidant | 0.025 |
| Perfume | 0.200 |
| Dye | 0.0008 |

These formulae were tested as below:

| Ref | Product | Dosage (g/wash) |
|---|---|---|
| 1 | Laundry detergent powder (PCB and TAED containing) + Product A | 80 + 2 ml on each stain |
| 2 | Laundry detergent powder (PCB and TAED containing) + Product B | 80 + 2 ml on each stain |
| 3 | Laundry detergent powder (PCB and TAED containing) + Product C | 80 + 2 ml on each stain |

The washing conditions used tap water at 25° F. hardness, 40° C. washing under a deep cleaning program in a front-loading European washing machine, using 3.5 kg of new and clean cotton ballast, with four replications. Final drying in a tumble drier and ironing of technical swatches. Instrumental evaluation was performed via spectrophotometer (Y value), where mean and standard deviation of 8 measurements (2 measurements each swatch) were calculated. Evaluation of statistical differences was calculated with the t-test (two sided case, 95% statistical certainty) according to ISO 2854 (1976, page 14 Table C).

The laundry additive was dosed directly on each stain (2 ml), left for 10 minutes; the stain was rubbed and put through the standard wash cycle described above.

The following results were obtained

| | Product A | Product B | Product C |
|---|---|---|---|
| butter (equest) | 28.3 | 27.9 | 27.8 |
| mustard (CFT) | 79.9 | 75.9 | 75.6 |
| make up (empa) | 85.6 | 71.7 | 82.2 |
| hamburger grease (white cot.-equest) | 87.3 | 77.7 | 87.4 |
| olive oil (equest) | 88.3 | 76.9 | 88.3 |
| skin grease (wfk) | 75.4 | 53.3 | 74.8 |
| dirty motor oil (wfk) | 74.4 | 50.5 | 73.2 |
| motor oil (wfk) | 79.7 | 54.7 | 76.6 |
| soy sauce (wfk) | 88.5 | 83.1 | 87.8 |
| salad dressing (cft) | 77.3 | 51.6 | 76.7 |
| potato starch (cft) | 64.8 | 60.4 | 65 |
| rice starch (cft) | 74.3 | 65 | 70.9 |
| chocolate bar (equest) | 86.6 | 76.6 | 84.4 |
| carrot baby food (equest) | 83.2 | 73 | 83.3 |
| blueberry juice (cft) | 79.9 | 76.3 | 78.8 |
| grass (empa) | 73 | 69.5 | 70.7 |
| red wine (equest) | 78.7 | 67.7 | 78.9 |
| tomato puree (equest) | 76.3 | 70.8 | 78.2 |
| tea (wfk) | 84.5 | 75.2 | 81.4 |
| coffee (wfk) | 82.5 | 77.3 | 81.6 |
| curry (wfk) | 85.2 | 81 | 84 |

The results show that the composition of the invention achieves better performance compared to the reference additive on: butter, mustard, make up, motor oil, soy sauce, rice starch, chocolate bar, blueberry juice, grass, tea, curry.

The comparison composition doesn't achieve any better performance while achieves worse performance compared to the reference additive on: make up, hamburger grease, olive oil, skin grease, dirty motor oil, motor oil, soy sauce, salad dressing, potato starch, rice starch, chocolate bar, carrot baby food, blueberry juice, red wine, tomato puree, tea, coffee, curry.

A key benefit that has been observed is when the composition/method of the invention is used in a pre-treatment operation (in particular when compared to the same formulation containing standard softening agents such as polyquat and silicone), delivering better stain removal performance. Polyquat and silicone actives are filming on the stains making them harder to be removed.

Example 2

A formulation in accordance with the invention was prepared as below. (product A)

| Description | % as active |
|---|---|
| LAS | 6.400 |
| Nonionics | 12.950 |
| $H_2O_2$ | 9.000 |
| Antioxidant | 0.025 |
| HEDP-Phosphonate | 0.200 |
| Dye | 0.00037 |
| Fragrance | 0.500 |
| optical brightener | 0.100 |
| Opacifier | 0.030 |
| anionic polyurethane | 0.650 |
| Perlizer | 0.300 |
| Water | 69.845 |

A comparative formulation was prepared as below. (Product B)

| Description | % as active |
|---|---|
| LAS | 6.600 |
| Nonionics | 12.850 |
| $H_2O_2$ | 8.000 |
| Antioxidant | 0.025 |
| HEDP-Phosphonate | 0.200 |
| Dye | 0.0008 |
| Fragrance | 0.200 |
| optical brightener | |
| Opacifier | |
| anionic polyurethane | |
| Perlizer | |
| Water | 72.124 |

These formulae were tested as below:

| Ref | Product | Dosage (g/wash) |
|---|---|---|
| 1 | Laundry detergent powder (DAZ) | 68 + 0 ml |
| 2 | Laundry detergent powder (DAZ) + Product A | 68 + 120 ml |
| 3 | Laundry detergent powder (DAZ) + Product A | 68 + 120 ml |

The washing conditions used tap water at 28° F. hardness, 40° C. washing under a deep cleaning program in a front-loading European washing machine (Bosch 20162), using 3.5 kg of new and clean cotton ballast, with four replications. Final drying in a tumble drier and ironing of technical swatches. Instrumental evaluation was performed via spectrophotometer (Y value), where mean and standard deviation of 8 measurements (2 measurements each swatch) were calculated. Evaluation of statistical differences was calculated with the t-test (two sided case, 95% statistical certainty) according to ISO 2854 (1976, page 14 Table C).

The following results were obtained

| Stains: | | Product A | Product B | Product C |
|---|---|---|---|---|
| Enzymatic | blood (Equest) | 80.9 | 88.5 | 88.1 |
| | cocoa drink | 64.8 | 70.6 | 63.7 |
| | salad dressing/pigment | 63.5 | 66.0 | 65.0 |
| | potato starch/colorant | 67.2 | 69.8 | 68.9 |
| | rice starch/colorant | 75.2 | 77.3 | 77.1 |
| | chocolate | 63.7 | 71.0 | 69.4 |
| | blood (empa) | 85.0 | 82.0 | 80.3 |
| | chocolate pudding | 87.0 | 88.4 | 87.5 |
| Bleach | red wine | 77.1 | 87.3 | 86.2 |
| | tomato puree | 72.9 | 76.4 | 75.4 |
| | blueberry juice | 72.7 | 83.0 | 82.3 |
| | blackberry juice | 54.1 | 69.8 | 69.4 |
| | grass (empa) | 66.4 | 73.0 | 72.5 |
| | coffee | 76.7 | 83.4 | 82.3 |
| | tea | 64.3 | 78.9 | 78.2 |
| | curry | 77.8 | 79.7 | 78.7 |
| | grass (CFT) | 77.6 | 80.8 | 80.3 |
| Detergency/ greasy | cooked beef fat | 84.7 | 88.1 | 87.5 |
| | olive oil (blue cotton) | 27.1 | 27.6 | 27.8 |
| | butter (blue cotton) | 25.9 | 26.4 | 26.2 |
| | mustard | 72.1 | 73.1 | 71.9 |
| | make up (empa) | 70.5 | 72.1 | 71.9 |
| | skin grease pigment | 54.6 | 57.8 | 58.6 |
| | dirty motor oil | 45.0 | 46.7 | 46.2 |
| | motor oil/pigment | 50.8 | 55.7 | 55.2 |
| | spaghetti sauce with meat | 59.3 | 60.8 | 59.1 |
| | soy sauce | 85.7 | 86.8 | 86.4 |

The results show that the composition of the invention achieves better performance compared to the reference additive on: cocoa, potato starch, chocolate, blueberry juice, coffee, curry, grass, spaghetti sauce with meat, soy sauce.

The invention claimed is:

1. A method of cleaning a fabric material, the method comprising the step of: applying to the fabric material a composition comprising a source of oxygen and a polyurethane, wherein the polyurethane comprises polyoxyalkylene groups and ionic groups, wherein the ionic groups are selected from alkali carboxvlate groups, ammonium carboxvlate groups, sulfonate groups and ammonium groups, which are present in an amount of 0.1 to 15 milliequivalents of ammonium, sulfonium, carboxylate, and/or sulfonate groups per 100 g of polyurethane.

2. The method of claim 1, wherein the amount of polyurethane present in the composition is from 0.1 to 10% wt.

3. The method of claim 1, wherein the composition is applied to the fabric material as a pre-treatment composition in a laundry/fabric washing operation.

4. The method of claim 3, wherein the composition is applied to stains present on the fabric, prior to a subsequent laundry/fabric washing operation.

5. The method of claim 4, wherein the composition comprises 0.01-10% wt. of polyurethane, and up to about 13% wt. of the source of oxygen.

6. The method of claim 5, wherein the composition comprises 1-12% wt. of the source of oxygen.

7. The method of claim 6, wherein the composition comprises 2-11% wt. of the source of oxygen.

8. The method of claim 7, wherein the composition comprises 3-10% wt. of the source of oxygen.

9. The method of claim 8, wherein the composition comprises 4-9% wt. of the source of oxygen.

10. The method of claim 1, wherein the source of oxygen is a composition comprising oxygen bleach andor a peroxygen bleaching active.

11. The method of claim 4, wherein the composition comprises 0.05- 5 wt % of the polyurethane.

12. The method of claim 11, wherein the composition comprises 0.08-3 wt % of the polyurethane.

13. The method of claim 12, wherein the composition comprises 0.1%-0.8 wt % of the polyurethane.

14. The method of claim 1, wherein the polyurethane comprises terminal polyalkylene oxide chains with an ethylene oxide unit content of 0.5-10 wt. %, relative to the polyurethane.

15. The method of claim 1, wherein the polyurethane is a polyether-based sulfite-blocked oligourethane.

16. The method of claim 15, wherein the polyurethane is a sodium hydrogensulphite adduct of an ethylene oxide/propylene oxide copolymer reacted with a diisocyanate.

17. The method of claim 16, wherein the diisocyanate is hexamethylene diisocyanate.

18. A method of cleaning a fabric material, the method comprising the step of: applying to the fabric material a composition comprising a source of oxygen and a polyurethane, wherein the polyurethane is a polyether-based sulfite-blocked oligourethane.

19. The method of claim 18, wherein the polyurethane is a sodium hydrogensulphite adduct of an ethylene oxide/propylene oxide copolymer reacted with a diisocyanate.

* * * * *